US008733379B2

(12) United States Patent
Kwon

(10) Patent No.: US 8,733,379 B2
(45) Date of Patent: May 27, 2014

(54) WALKING SUPPORTER

(71) Applicant: Yongbeom Kwon, Seoul (KR)

(72) Inventor: Yongbeom Kwon, Seoul (KR)

( * ) Notice: Subject to any disclaimer, the term of this patent is extended or adjusted under 35 U.S.C. 154(b) by 0 days.

(21) Appl. No.: 13/848,726

(22) Filed: Mar. 21, 2013

(65) Prior Publication Data

US 2013/0291912 A1 Nov. 7, 2013

(30) Foreign Application Priority Data

May 4, 2012 (KR) ..... 20-2012-0003718 U

(51) Int. Cl.
*A61H 3/00* (2006.01)

(52) U.S. Cl.
USPC ..... 135/67; 135/84

(58) Field of Classification Search
USPC ..... 135/67, 84; 16/42 R, 42 T
See application file for complete search history.

(56) References Cited

U.S. PATENT DOCUMENTS

| | | | | | |
|---|---|---|---|---|---|
| 267,680 | A * | 11/1882 | Crandall | 135/68 |
| 1,254,061 | A * | 1/1918 | Mueller | 135/83 |
| 1,277,009 | A * | 8/1918 | Weldon | 135/68 |
| 1,621,255 | A * | 3/1927 | Hunter | 135/68 |
| 2,627,904 | A * | 2/1953 | Thieman | 482/66 |
| 2,989,114 | A * | 6/1961 | Ecroyd | 280/15 |
| 3,633,906 | A * | 1/1972 | Fowler | 482/66 |
| 4,838,291 | A * | 6/1989 | DiVito | 135/68 |
| 5,335,683 | A * | 8/1994 | Ledley | 135/84 |
| 6,056,673 | A * | 5/2000 | Arrecis | 482/66 |
| 7,958,902 | B2 * | 6/2011 | Ruddy | 135/84 |

FOREIGN PATENT DOCUMENTS

| | | | |
|---|---|---|---|
| JP | 3075015 | U | 2/2001 |
| JP | 2004-275556 | A | 10/2004 |
| KR | 20-0306016 | Y1 | 3/2003 |
| KR | 10-2010-0124904 | A | 11/2010 |

* cited by examiner

*Primary Examiner* — Noah Chandler Hawk
(74) *Attorney, Agent, or Firm* — Korus Patent, LLC; Seong Il Jeong

(57) ABSTRACT

A walking supporter having a plurality of bottom frames with at least one curved element; a plurality of support frames connected to the curved element of the bottom frames; and at least one connecting element interconnecting the support frames. A user can stand up easily from a sitting position without exerting a force vertical to the ground because the walking supporter can be swung utilizing the bottom frame with a curved element. Furthermore, it is less likely that the walking supporter will get stuck even if there is a protrusion or a crevice on the ground because the bottom frame is formed of curved elements. The walking supporter is also appropriate for patients or the elderly who may not have enough arm-strength because it is possible to walk by pushing the walking supporter on the ground with a part of the bottom frame being in contact with the ground.

4 Claims, 6 Drawing Sheets

WALKING SUPPORTER

BACKGROUND

1. Field of the Invention

The present disclosure relates to a walking supporter, and more particularly, a walking supporter that comprises one or more bottom frames having a curved element.

2. Background of Related Art

While walking supporters including those for toddlers have been developed in the past, interest in walking supporters for the elderly has increased as the average age of population rises and the aging population increases.

Above all things, continuous product research and development to guarantee safety has been performed because the consumers for such walking supporters mainly correspond to patients, disabled people and the elderly.

FIG. 1 illustrates a conventional walking supporter 100 with four legs. As illustrated, the conventional walking supporter 100 comprises four support elements 120*a*, 120*b* being in contact with the ground where bottom part of the support elements may include rubber inserts 130*a*, 130*b* for preventing slipping or may adopt wheels 150*a*, 150*b*. In general, handles 110*a*, 110*b* are provided horizontal to the ground so that a user can grip the handles and walk by moving the walking supporter. However, disabled people and the elderly experience several inconveniences when using a conventional walking supporter 100.

First, when a user stands up using the walking supporter from a sitting position in a chair, the user has to bend their arms by ninety degrees and exert a force to the walking supporter vertically in order to stand up. That is, the user can stand up without slipping only by exerting a force vertically to the ground because the walking supporter stands vertically to the ground.

Second, where a protrusion or a crevice is on the ground, a user may fall down or be unable to continue walking when any of the four legs is hindered by the protrusion or crevice.

Third, patients or elderly people who have weak arm-strength have difficulty to use the walking supporter because they have to hold themselves up and move the walking supporter's four legs forward in order to walk.

Fourth, use of the walking supporter with four legs is restricted because it can't be used on stairs.

Fifth, a walking supporter with four legs can obstruct natural walking because it is stable only when the four legs are contact with the ground.

SUMMARY

The present disclosure is intended to resolve problems of the conventional walking supporter with four legs as illustrated in FIG. 1 and to provide a walking supporter with improved safety and utility.

The walking supporter according to the present disclosure comprises a support frame with a couple of support elements, a front support element and a rear support element; and a bottom frame connecting to the front support element and the rear support element wherein the bottom frame comprises at least one curved element having a circular arc shape.

In one embodiment, the bottom frame comprises a first curved element connected to the front support element and a second curved element connected to the rear support element where the first curved element and the second curved element are connected to each other and the bottom frame may further comprise an angled element.

In another embodiment, the bottom frame comprises a first curved element connected to the front support element and a second curved element connected to the rear support element where the first curved element and the second curved element are separated each other and the bottom frame may further comprise an angled element fixed in a support frame connected to the front support element and the rear support element.

Selectively, the first curved element and the second curved element may include a flat region having a predetermined length and being configured to be parallel to the ground. In addition, the support frame may be connected to the bottom frame at the center of an arc region or outside of the center of the arc region.

Since the walking supporter according to the present disclosure can be swung by utilizing the bottom frame with a curved element, a user can easily stand up from a sitting position without exerting a force vertically to the ground. Furthermore, it is less likely that the walking supporter will become stuck even if there is a crevice on the ground because the bottom frame is formed of curved elements. The walking supporter is also appropriate for patients or the elderly who may not have enough arm-strength because it is possible for them to walk by pushing the walking supporter on the ground with a part of the bottom frame being in contact with the ground.

The walking supporter according to the present disclosure provides the benefit of being used on stairs by having a connection element or an angled element which has an elbowed transition, thereby eliminating the conventional walking supporter's inconvenience of not being capable of use on stairs.

BRIEF DESCRIPTION OF THE DRAWINGS

The same reference numeral and symbol in various figures represent the same component.

DETAILED DESCRIPTION

Figure 1:
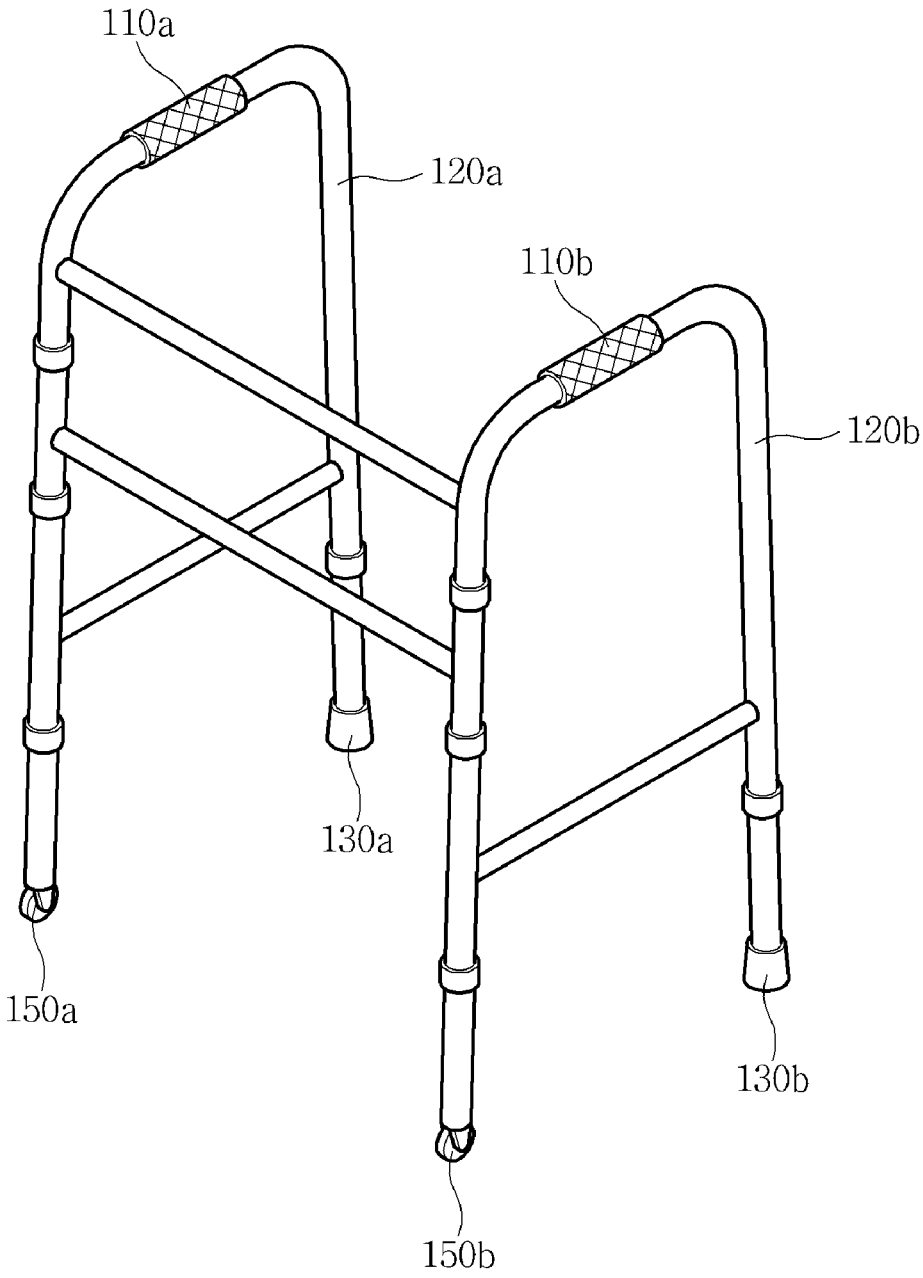
Prior Art FIG. 1
FIG. 1 is a perspective view of a conventional walking supporter.

Hereinafter, the present disclosure will be described in detail by explaining embodiments of a walking supporter with reference to the attached drawings. Please note that the same reference numeral and symbol in various figures represent the same component. In explaining embodiments, a detailed explanation has been omitted to the extent that the detailed explanation of a well-known configuration or function may disrupt the understanding of the embodiments.

Figure 2:
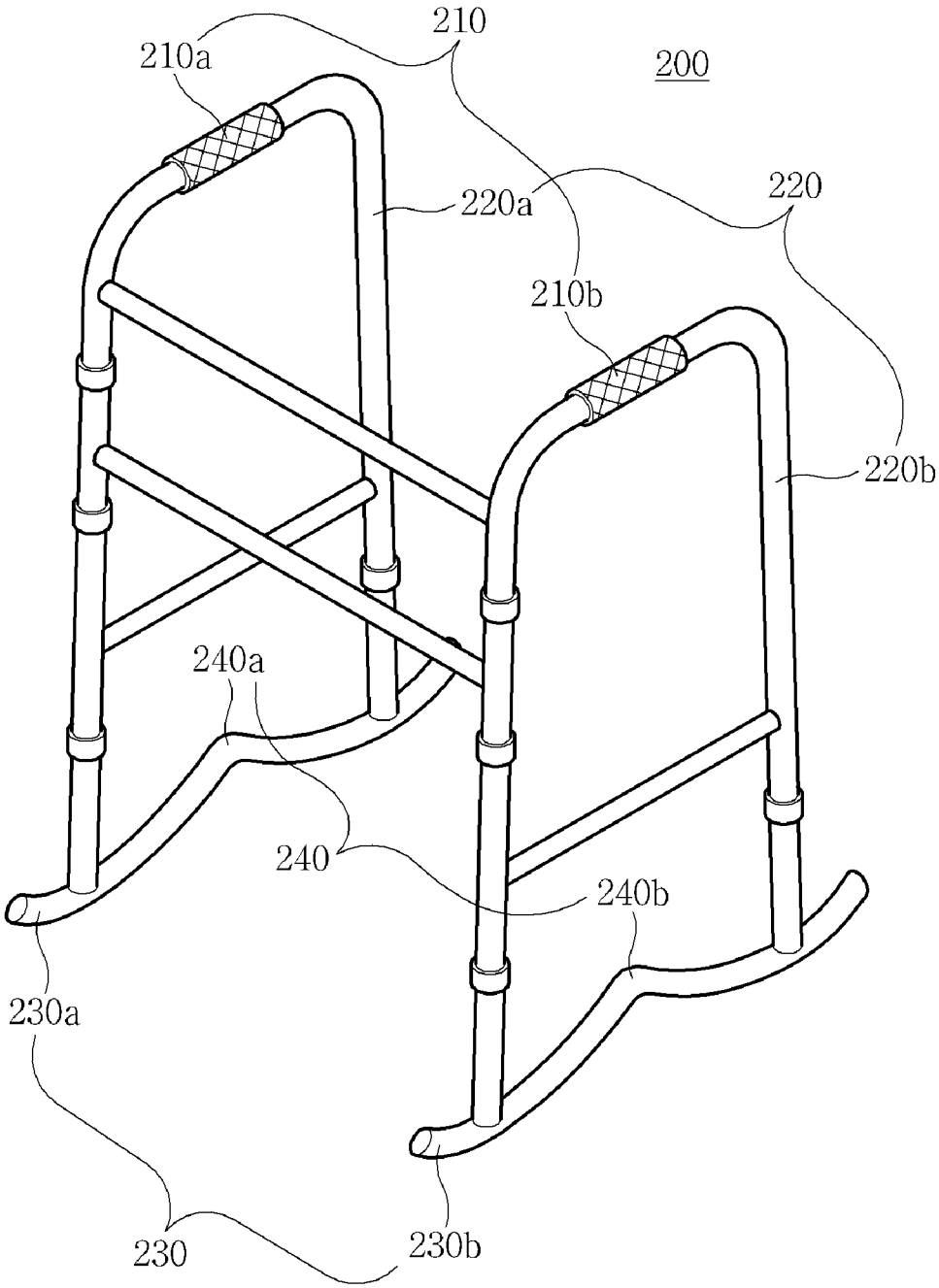
FIG. 2 is a perspective view of a walking supporter according to the present invention comprising a bottom frame with a curved element.

FIG. 2 is a perspective view of a walking supporter comprising a bottom frame with a curved element according to the present disclosure. The walking supporter 200 may comprise a handle 210, a support frame 220, a bottom frame 230, and an angled element 240.

The handle 210 represents a region of top frame connecting support frames 220*a*, 220*b* of the walking supporter 200 to each other, and represents the region which a user holds when using the walking supporter 200. In one embodiment, the handle 210 may be made with a different material from that of the support frame 220 to prevent slipping. In FIG. 2, the handle 210 is located in a support frame 220 horizontal to the ground; however, the handle 210 may be located in a vertical support frame, and more than two handles 210 may be used.

The support frames 220*a*, 220*b* represent leg parts of the walking supporter vertical to the ground. Referring to FIG. 2, the walking supporter 200 comprises the support frame 220 with support frames 220*a*, 220*b* consisting of a front support element and a rear support element wherein the support frame 220 is connected to the bottom frames 230*a*, 230*b*. In one embodiment, the height of the support frame may be adjusted according to a user's height.

The bottom frame 230 is a frame having a surface that is contact with the ground. A conventional walking supporter does not have such a bottom frame separately, but has four vertical frames that are contact with the ground or adopt wheels in a region that is in contact with the ground. However, the walking supporter 200 according the present invention comprises the bottom frame 230 separately wherein the bottom frame may comprise two curved elements as illustrated in FIG. 2. The support frame 220 is connected to the curved elements of the bottom frame 230 wherein the bottom frame 230 comprises at least one curved element. In one embodiment, the bottom frame 230 may be formed of a curved element that enables a large swing or comprises more than two curved elements for stability.

The support frames 220*a*, 220*b* may be located near a center region of the each curved element of the bottom frames 230*a*, 230*b*. In one embodiment, the support frames 220*a*, 220*b* may be located in the center of the curved element. In this embodiment, the stability of the walking supporter is enhanced because a contact point between the bottom frame and the ground and a connection point between the support frame and bottom frame are located in a single line when a user is standing up. However, when the support frames 220*a*, 220*b* are located in the center of the curved element, it is difficult for a user to utilize a horizontal force using a swing in order to stand up from a sitting position because the user has to exert a vertical force to stand up.

Therefore, it is preferable that the support frame be fixed outside of the center region of the curved element of the bottom frames 230*a*, 230*b* such that a user can stand up without exerting a force vertical to the ground to the walking supporter according to the present disclosure. A detailed explanation about this will be described referring to FIG. 3 and FIG. 4.

Figure 3:
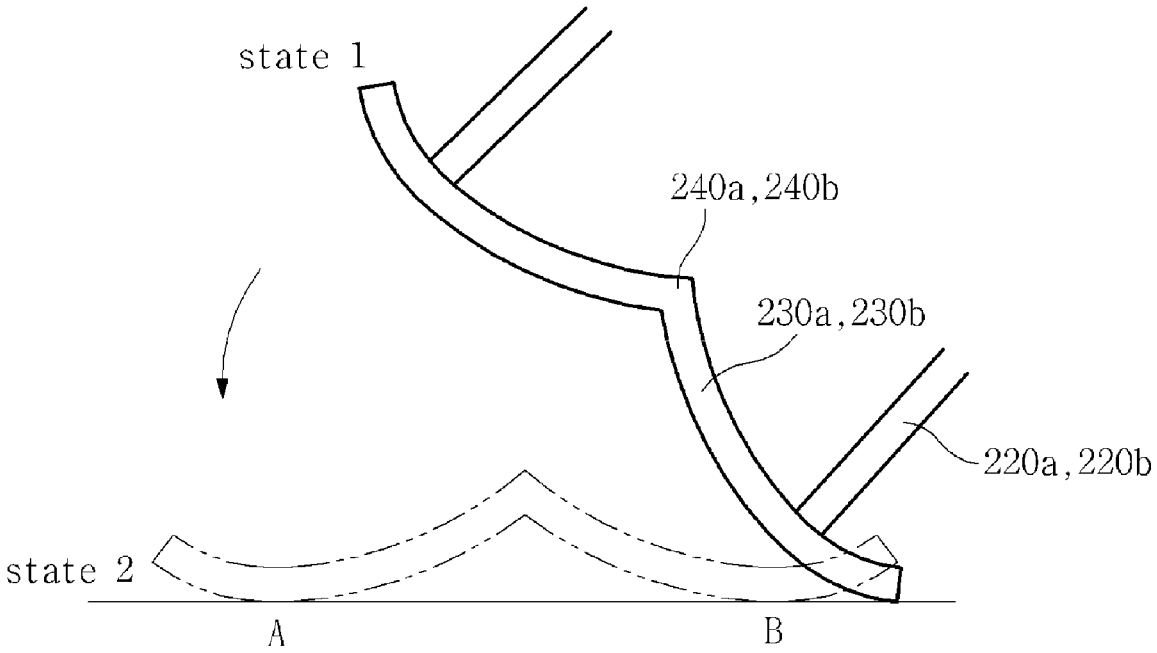
FIG. 3 illustrates a movement of bottom frames of a walking supporter according to the present invention when a user stands up from a sitting position.

FIG. 3 illustrates a movement of bottom frames 230*a*, 230*b* of a walking supporter according to the present disclosure when a user stands up from a sitting position. Referring to FIG. 3, when a user leans the walking supporter, an end of the bottom frames 230*a*, 230*b* will be contact with the ground as in State 1. After a user stands up completely by exerting a force to the walking supporter, points A and B of the bottom frames 230*a*, 230*b* are in contact with the ground as shown in State 2.

A conventional walking supporter, as shown in FIG. 1, always stands vertically to the ground because its four legs are formed vertically to the ground. However, the walking supporter according to the present disclosure can be swung back and forth by utilizing the bottom frames 230*a*, 230*b* with a curved element having a circular arc shape. In one embodiment, a user utilizing such a swing motion can stand up easily with a smaller force from a sitting position without exerting a force vertical to the ground if the user exerts a force toward the user-side end of the bottom frames 230*a*, 230*b* in State 1 because the bottom frames 230*a*, 230*b* move from State 1 to State 2.

A user can walk in one embodiment by pushing the walking supporter with points A and B of the bottom frames 230*a*, 230*b* being in contact with the ground. In this embodiment, the user can push the walking supporter easily because the walking supporter comprises a curved element with a smaller contact surface. In another embodiment, a user can walk pushing the walking supporter with only the front of point A being in contact with the ground by inclining the walking supporter. Thus, in the present disclosure, a user can walk, without holding the walking supporter up and down, pushing the walking supporter with only part of the curved element of the bottom frame being in contact with the ground.

While conventional walking supporters may adopt wheels in the legs of the frame so that a user can walk by pushing the walking supporter, there was an inconvenience that, when there is a crevice or hole in the ground, a user had to lift the conventional walker up to sidestep the crevice or hole. The walking supporter according to the present disclosure comprises bottom frames 230*a*, 230*b* with curved elements so that a user can walk without such inconvenience even if there is a crevice or hole in the ground.

Figure 4:
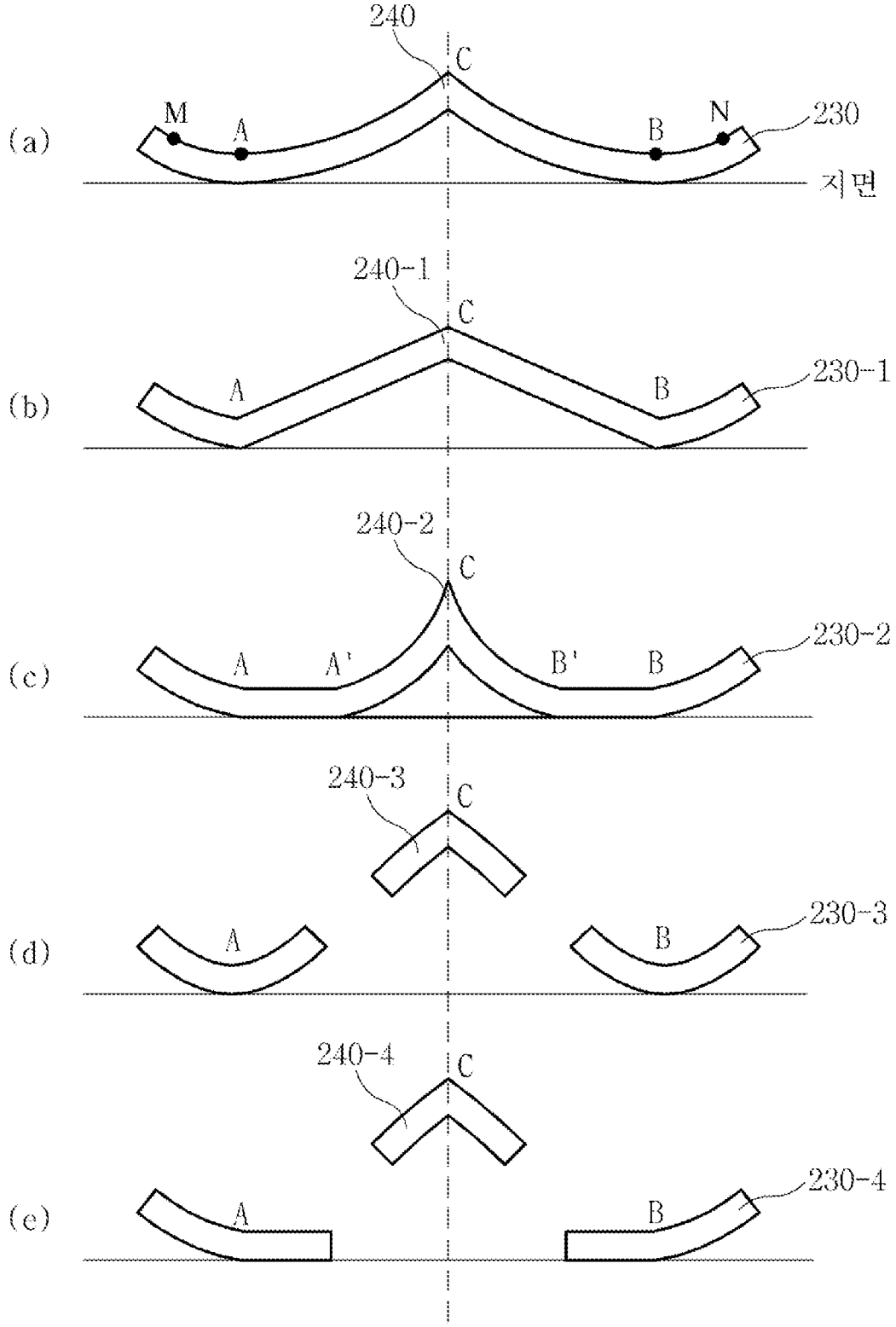
FIGS. 4(*a*) to (*e*) illustrate various embodiments of bottom frames of a walking supporter according to the present invention.

FIGS. 4(*a*) to 4(*e*) illustrate various embodiments of bottom frames 230*a*, 230*b* of a walking supporter according to the present disclosure. FIGS. 4(*a*) to 4(*c*) illustrate bottom frames formed with two curved elements wherein the two curved elements are connected such that a connection region of the bottom frames comprises an angled element. FIGS. 4(*d*) and 4(*e*) illustrate embodiments that the bottom frames are formed such that two curved elements and an angled element are separated. A curved element with a point A being in contact with the ground is referred to a first curved element and a curved element with a point B being contact with the ground is referred to a second curved element.

FIG. 4(*a*) illustrates an embodiment having a bottom frame 230 where the first curved element and the second curved element have a circular arc shape and the first curved element and the second curved element are connected each other. The walking supporter according to the present disclosure may comprise a bottom frame with two curved elements having a circular arc shape providing stability for a user who is standing or performing a swing motion when a user walks or tries to stand from a sitting position. In one embodiment, the bottom frame 230 may be formed of one curved element for a larger swing or may be formed of two or more curved elements for stability.

Furthermore, an angled element 240 connecting the first curved element and the second curved element may be formed to have an elbowed shape. This is to resolve a problem that conventional walking supporters can't be used on stairs. A user can fix the walking supporter by putting the angled element into an edge of the stairs and can ascend the stairs by exerting on the walking supporter with the angled element being put into an edge of the stairs.

In another embodiment, as long as the bottom frame 230-1 comprises a curved element for swing motion and an angled element for using in the stairs, each connecting line A-C and B-C may be a straight line as shown in FIG. 4(*b*).

In another embodiment of FIG. 4(*c*), the contact area of a bottom frame 230-2 being in contact with the ground may be increased to enhance the stability of the walking supporter when a user is standing by holding the walking supporter. That is, it may be formed to have a flat region like A-A' and B-B' rather than having a circular arc shape. Stability may be improved as the flat region becomes longer and the flat region may be implemented shorter or longer than that of FIG. 4 (*c*).

FIGS. 4(*d*) and 4(*e*) illustrate bottom frames 230-3, 230-4 where a first curve element and a second curved element are separated. As shown in FIG. 4(*a*), the bottom frame may comprise two curved elements and an angled element 240-3, 240-4 even if the two curved elements are not connected each other. As described above, the angled elements 240-3, 240-4 are intended for a user to use the walking supporter in the stairs.

FIG. 4(*e*) illustrates a bottom frame 230-4 that is formed of partially curved region and partially flat region, as in FIG. 4(*c*), to enhance stability by increasing contact area with the ground. As in FIG. 4(*d*), the bottom frame comprises two curved elements so that the walking supporter can be swung back and forth. In this embodiment, the contact region may be flat and an angled element 240-4 may be formed separately.

In FIGS. 4(*a*) to 4(*e*), the bottom frame in each embodiment is connected to a support frame that is formed vertically to the ground. The support frames may be connected to the bottom frames 230, 230-1, 230-2, 230-3, 230-4 in FIG. 4 at points where the bottom frame is in contact with the ground, for example, at A and B in FIG. 4(*a*) or may be connected to points other than at A and B, for example, M and N in FIG. 4(*a*). Because, when the support frames are connected to points inside than A and B, the walking supporter may not be swung easily, the support frame may be connected to points A and B or points other than at A and B for an easy swing.

Figure 5:
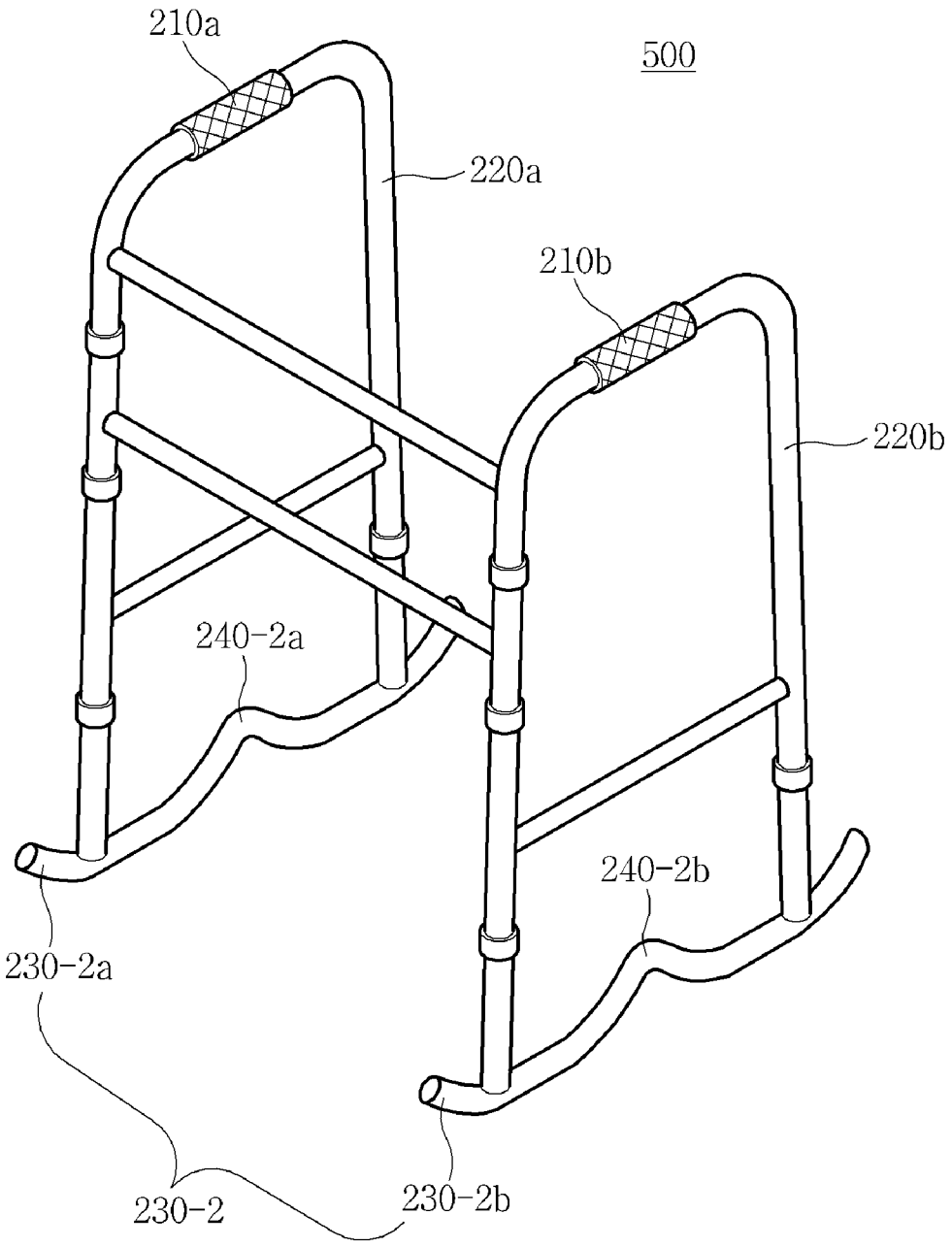
FIG. 5 illustrates an embodiment of the present invention comprising the bottom frame of FIG. 4(*c*).

In one embodiment of the present invention, FIG. 5 illustrates a walking supporter with the bottom frame illustrated in FIG. 4(*c*). Referring to FIG. 5, the walking supporter 500 comprises handles 210*a*, 210*b*, support frames 220*a*, 220*b*, and bottom frames 230-2*a*, 230-2*b* wherein the bottom frames 230-2*a*, 230-2*b* comprise angled elements 240-2*a*, 240-2*b* as connection elements that are formed in the same surface with curved elements of the bottom frames.

The handles 210*a*, 210*b*, in one embodiment, are located at support frames that are horizontal to the ground, but may be located at support frames that are vertical to the ground and are near to a user.

The bottom frame 230-2 may comprise two curved elements, a first curved element and a second curved element, that are connected each other. By using such curved elements, a user can easily stand up by exerting a force to the walking supporter with the walking supporter being inclined to the user and can walk by pushing the walking supporter with the walking supporter being inclined towards a user's walking direction. In FIG. 5, the walking supporter with the bottom frame having a flat region that is in contact with the ground is illustrated. As the contact area increases, the stability of the walking supporter may be enhanced.

In one embodiment, the bottom frames 230-2*a*, 230-2*b* may be formed to be parallel each other as in illustrated in FIG. 5, but the bottom frames 230-2*a*, 230-2*b* do not have to be parallel to each other. The reason for having two bottom frames is to provide stability and the ability for a user to swing the walking supporter without obstructing the user's walking.

The angled elements 240-2*a*, 240-2*b* formed in a connection region of the curved elements of the bottom frame 230-2 may be used for a user to ascend stairs by putting the angled elements to an edge of the stairs. In the FIG. 5, the height of the angled elements is illustrated to be equal to the height of the curved elements, but the height may be adjusted to a lower or higher from the ground.

The height of the support frames 220*a*, 220*b* may be adjusted such that a user can hold and control the walking supporter when the user swings the bottom frames, pushes the walking supporter to a direction, or stands up by holding it. The support frames 220*a*, 220*b* are connected to the bottom frames 230-2*a*, 230-2*b*. In one embodiment, the support frames are connected to the bottom frames at the center of the flat region or outside end of the flat region, a boundary area of the flat region and the curved region.

Figure 6:
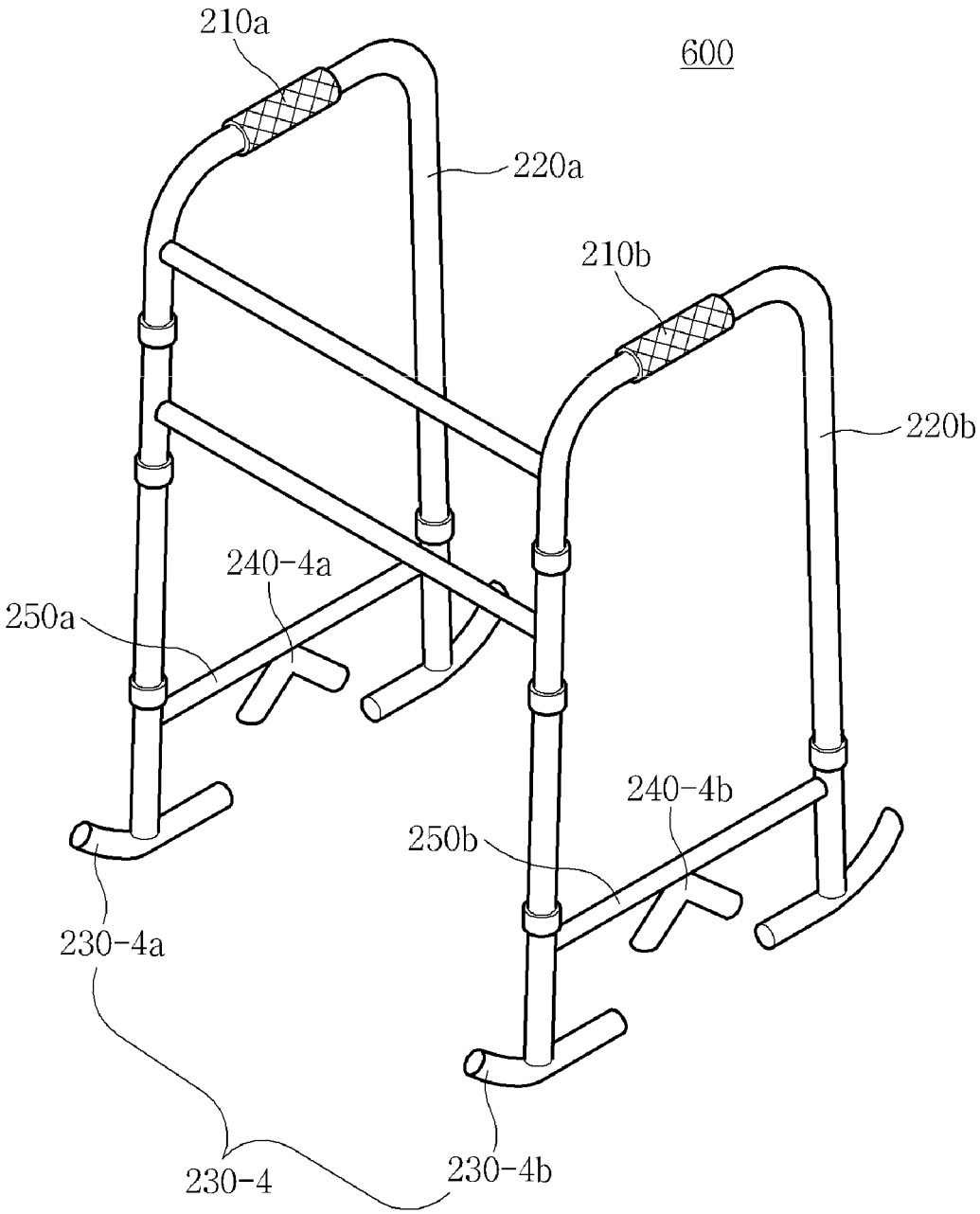
FIG. 6 illustrates an embodiment of the present invention comprising the bottom frame of FIG. 4(*e*).

In another embodiment, FIG. 6 illustrates a walking supporter 600 with the bottom frame 230-4 illustrated in FIG. 4(*e*). The walking supporter 600 comprises handles 210*a*, 210*b*, support frames 220*a*, 220*b*, and bottom frames 230-4*a*, 230-4*b* like the walking supporter 500 as in FIG. 5, but curved elements of the bottom frames are separated as implemented in FIG. 4 (*e*).

The curved elements of the bottom frames 230-4*a*, 230-4*b* may be separated as illustrated in FIG. 6 as long as they implement the function of the walking supporter 600 as suggested in the present disclosure. Each curved element including flat region is connected to the support frame vertical to the ground individually and angled elements 240-4*a*, 240-4*b* used for ascending stairs may be also connected to the support frame individually. Each curved element and angled element are formed in the same surface even if they are separated.

According to embodiments of the present disclosure described above, the walking supporter 600 can be swung utilizing the bottom frames 230-4*a*, 230-4*b* with curved elements so that a user can use the walking supporter 600 in an inclined state when walking or standing up and also can ascend stairs utilizing the angled elements 240-4*a*, 240-4*b*.

Because some specific embodiments have been described in detail to help understand, the components, their connection and relation, and their functions in this disclosure are examples. Each embodiment may be changed to various embodiments within the scope of the disclosure. For example, as illustrated in FIGS. 4(*a*) to 4(*e*), walking supporters having various bottom frames comprising curved elements and angled elements may be suggested within the scope of the present disclosure.

Furthermore, the components 210, 220, 230, 240 in the present disclosure are implemented as an integral body, but the components may be implemented as physically separated or partially integrated.

While this invention has been particularly shown and described with reference to embodiments thereof, it will be understood by those skilled in the art that various changes in form and details may be made therein without departing from the spirit and scope of the invention as defined by the appended claims.

REFERENCE NUMERALS

100 conventional walking supporter
110*a*, 110*b* handle
120*a*, 120*b* support frame
130*a*, 130*b* rubber insert
140*a*, 140*b* wheel
200 walking supporter
210*a*, 210*b*, 210 handle
220*a*, 220*b*, 220 support frame
230*a*, 230*b*, 230 bottom frame
240*a*, 240*b*, 240 angled element
500 walking supporter
600 walking supporter

What is claimed is:

1. A walking supporter comprising:

a pair of support frames, the support frame having at least two support elements including a front support element and a rear support element;

at least one connecting element of a predetermined length interconnecting the pair of support frames each other; and a pair of bottom frames, the bottom frame comprising a plurality of curved elements having a circular arc shape including a first curved element and a second curved element, the first curved element being connected to the front support element, the second curved element being connected to the rear support element, and an angled element connecting the first curved element and the second curved element as one body and having an elbowed transition at substantially the middle thereof, whereby a user can fix the walking supporter by putting the angled element to an edge of stairs and can ascend the stairs by exerting a force on the walking supporter with the angled element being put into the edge of stairs.

2. The walking supporter of claim 1, wherein the first curved element and the second element comprise a flat region having a predetermined length at a contact region with the ground, the flat region being parallel to the ground.

3. The walking supporter of claim 1, wherein the support frame is connected to the bottom frame at substantially the middle of the circular arc of the first and second curved elements or outside of the middle of the circular arc of the first and second curved elements.

4. A walking supporter comprising:

a pair of support frames, the support frame having at least two support elements including a front support element and a rear support element;

at least one connecting element of a predetermined length interconnecting the pair of support frames each other; and a pair of bottom frames, the bottom frame comprising a plurality of curved elements having a circular arc shape including a first curved element and a second curved element, the first curved element being connected to the front support element, the second curved element being connected to the rear support element, and an angled element disposed at substantially the middle of a bottom support element connecting the front support element and the rear support element, the first curved element and the second curved element being separate from each other and the angled element having an elbowed transition at substantially the middle thereof, whereby a user can fix the walking supporter by putting the angled element to an edge of stairs and can ascend the stairs by exerting a force on the walking supporter with the angled element being put into the edge of stairs.

* * * * *